US007506771B2

(12) United States Patent
Bianchini

(10) Patent No.: US 7,506,771 B2
(45) Date of Patent: Mar. 24, 2009

(54) WALL RACK FOR CYLINDRICAL CONTAINERS

(76) Inventor: Robert D. Bianchini, 1407 White Spruce Dr., Toms River, NJ (US) 08753

( * ) Notice: Subject to any disclaimer, the term of this patent is extended or adjusted under 35 U.S.C. 154(b) by 395 days.

(21) Appl. No.: 11/373,626

(22) Filed: Mar. 13, 2006

(65) Prior Publication Data

US 2007/0210022 A1 Sep. 13, 2007

(51) Int. Cl.
*A47B 73/00* (2006.01)

(52) U.S. Cl. ..... 211/75

(58) Field of Classification Search ..... 211/74–76, 211/87.01, 85.18, 94.01, 70.6, 86.01; 215/376, 215/378, 370, 395, 400
See application file for complete search history.

(56) References Cited

U.S. PATENT DOCUMENTS

| | | | | | |
|---|---|---|---|---|---|
| 950,572 | A * | 3/1910 | Moore | 312/45 |
| 2,155,884 | A * | 4/1939 | Barnes | 211/74 |
| 2,338,310 | A * | 1/1944 | Barnes | 211/74 |
| 2,580,676 | A * | 1/1952 | Gross | 211/75 |
| 3,650,381 | A * | 3/1972 | Weindling | 206/742 |
| 3,901,389 | A * | 8/1975 | Belokin, Jr. | 211/74 |
| 4,064,992 | A * | 12/1977 | Ralston et al. | 211/75 |
| 4,378,889 | A * | 4/1983 | Lebowitz | 211/75 |
| 4,795,038 | A * | 1/1989 | Johnson | 211/74 |
| D303,899 | S * | 10/1989 | Ancona et al. | D7/600.2 |
| D329,153 | S * | 9/1992 | Kijanka et al. | D6/467 |
| 5,452,810 | A * | 9/1995 | Schwartz | 211/74 |
| 6,964,343 | B2 * | 11/2005 | Tilly | 211/74 |
| 2003/0178381 | A1 * | 9/2003 | Liang | 211/74 |
| 2007/0017884 | A1 * | 1/2007 | Yang | 211/74 |

* cited by examiner

*Primary Examiner*—Jennifer E. Novosad

(57) ABSTRACT

A plurality of removable cylindrical containers upwardly angled within apertures of a storage rack secured to a wall between spaced-apart studs for storing beneath individually marked openable closure lids various screws, washers, nuts, bolts, etc. of different size, composition and type as used by craftsmen and mechanics.

10 Claims, 3 Drawing Sheets

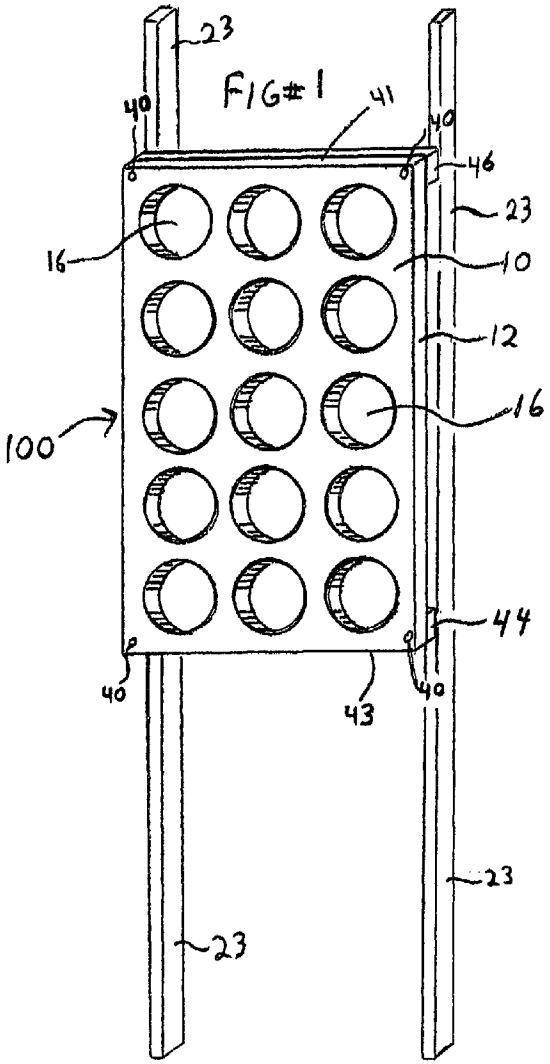
FIG#1

FIG#3
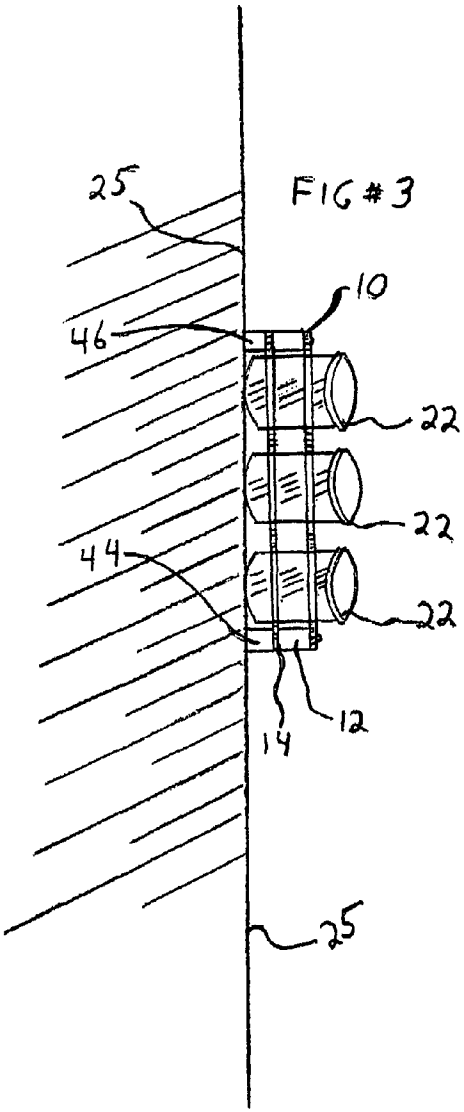
FIG#2
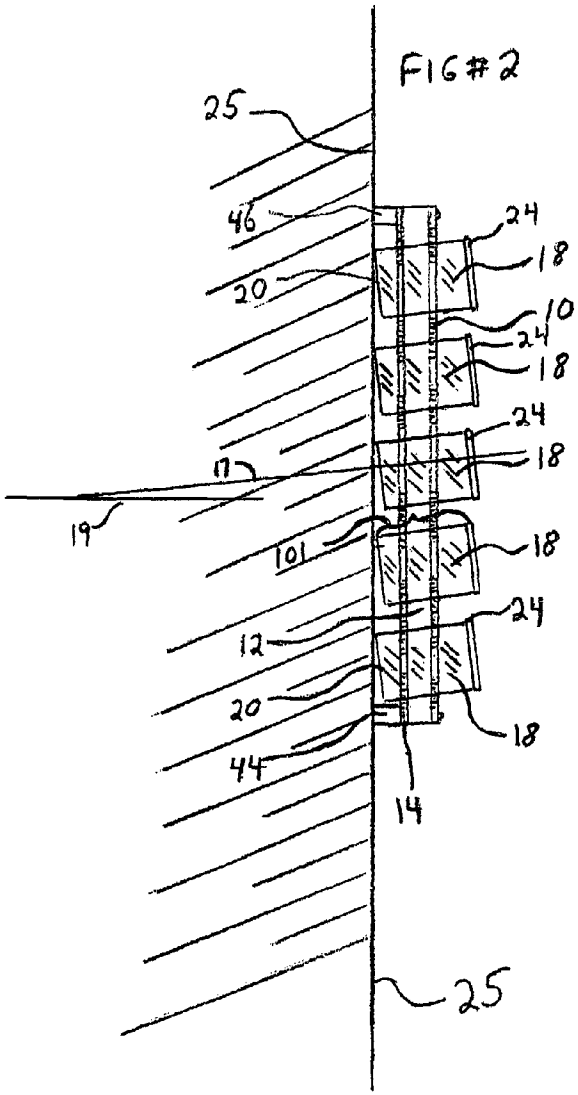

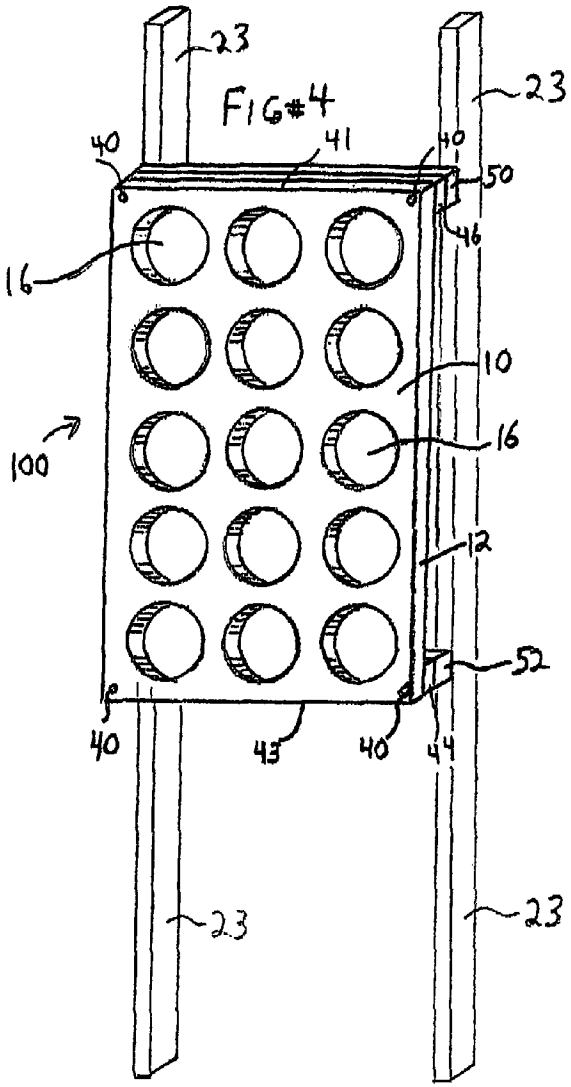
FIG#4

WALL RACK FOR CYLINDRICAL CONTAINERS

CROSS-REFERENCE TO RELATED APPLICATIONS

None.

STATEMENT REGARDING FEDERALLY SPONSORED RESEARCH OR DEVELOPMENT

Research and development of this invention and Application have not been federally sponsored, and no rights are given under any Federal program.

REFERENCE TO A MICROFICHE APPENDIX

Not Applicable

BACKGROUND OF THE INVENTION

1. Field of the Invention

This invention relates to storage racks as may be employed by craftsmen and mechanics, in general, and to storage racks for containing such items as screws, nuts, washers, bolts, springs, dowels, nails, knobs, anchors and caps of different size, composition and types as are utilized in the shops and garages of home craftsmen and mechanics, in particular.

2. Description of the Related Art

As will be appreciated by such home craftsmen and mechanics, storing all types of these devices in containers on shelves leaves much to be desired. First of all, many types of containers are required to store each item separately. Secondly, when stored on a shelf, it becomes difficult to determine exactly what contents are stored in each container. Thirdly, as typically happens, what is being looked for is located in a container at the back of a shelf—and, therefore, everything on the shelf in front of it must be moved away and/or about in order to get the container whose contents are desired to be worked with. While some home-do-it-yourselfers take to storing these items in empty baby food bottles, such containers oftentimes are too small to carry the quantity of nails, bolts, anchors, caps and the other relatively large items of this nature. Additionally, it is not unusual for these types of containers to slip off the shelf, fall to the ground, and shatter when looking for that one or two containers of interest located at the rear of the shelf. Large containers, on the other hand, take up too much room on the shelf to enable the storing of more than a handful of these types of devices. While a "week-end", "once-in-a-while" fixer-upper apartment or home dweller might not care if brads, washers, nuts, and caps are mixed together, for the quality or professional worker, that is generally not acceptable—they should all be kept separate.

OBJECTS OF THE INVENTION

It is an object of the present invention, therefore, to provide some new form of container compartment apparatus for the storage of those types of devices used by the craftsman or mechanic who employ them on more than just an occasional basis.

It is an object of the invention, also, to provide such container compartment apparatus where the contents of each container can be easily identified.

It is object of the present invention, additionally, to provide such apparatus which allows for the easy removal of any one or more containers so that they can be taken outdoors, if need be, or to any place indoors, where desired work is to be done.

It is a further object of the invention to provide and install such container compartment apparatus at space typically in a home that is not generally being used already for some other purpose.

It is yet another object of the invention to provide such container compartment apparatus which can be easily installed and put to use with almost no effort at all.

It is a still further object of the invention to provide such apparatus which can be put to immediate use upon being brought home from any point of purchase.

As will be appreciated by those skilled in the art, it is also an object of the invention to provide such container compartment apparatus available in different sizes to accommodate almost any need of storage desired by the craftsman or mechanic—at home or at a place of business—for the particular job or jobs typically called upon to be done.

SUMMARY OF THE INVENTION

As will become clear from the following description, the container compartment apparatus of the invention is particular useful where a plurality of cylindrical coffee cans are used for the storage. A rack of given thickness from front to back is provided with a plurality of substantially circular apertures cut through into which the coffee cans are inserted. Openable closure lids of plastic composition, for example, are sized to fit the containers, and include a written identification of any contents that are placed within the can.

The rack is then mounted to spaced-apart studs at a wall surface (of an inside garage, for example), and in any appropriate manner. To facilitate the finding of the desired container, they may all be arranged in a grid pattern on the rack, with the containers being tilted upwardly from back to front so that their contents can be easily removed. In accordance with a preferred embodiment of the invention that simplifies and allows this, the containers are tilted upwardly at an angle between 6° and 15° for optimum withdrawal, while keeping the contents from falling out even if the closure lid for the containers were removed. By employing plastic closure lids, felt-tip markers can easily be employed to write the contents onto the lids for ease of identification. And to permit the removal of the entire coffee can container, the apertures are cut of a diameter greater than that of the container itself.

As will also be seen, different manners are presented for mounting the storage rack to the vertical studs—although, in general, any type of vertical extending rails that are spaced apart may be used to receive the storage rack. Moreover, a thickness is selected for the rack itself, so that only a portion of the coffee can extends forwardly of the rack, the remainder of the can extending through to be supported by the garage, or other wall surface behind. As described, the upward 6°-15° angle can be provided by offsetting the cutting of the apertures in the rack, or by the use of spacer bars or spacer feet which couple the back of the rack to the wall.

Particularly good results have followed the use of 13 ounce coffee cans of 4 inch diameter inserted within 4-¼ inch diameter cut apertures. Other container sizes may be utilized as well—and containers other than coffee cans may be employed. About the only limitation is that the material selected for the rack and its thickness be strong enough to support the weight of each content-loaded container in order to maintain its structural integrity. The preferred embodiment of the invention, for example, employs a storage rack of wood composition, configured to support 15 such coffee cans in 3 columns of 5 rows each—although a more extensive construction of 4 columns of containers in 9 rows each has been utilized in a more extensive arrangement. Analysis has shown, however, that a 15 container, coffee can arrangement of 13 ounce size would fit most purposes, and that a rack of such size can be easily nailed, bolted, or otherwise secured to 16 inch spaced-apart wall studs, with the containers then just fitted in place.

BRIEF DESCRIPTION OF THE DRAWINGS

These and other features of the present invention will be more clearly understood from a consideration of the following description, taken in connection with the accompanying drawings, in which:

FIGS. 1, 2 and 3 are front, side and top views of a wall rack for cylindrical containers in accordance with a preferred embodiment of the invention;

FIG. 4 is a pictorial view showing how the invention may be utilized in one particular craftsman/mechanic construction.

DETAILED DESCRIPTION OF THE INVENTION

Referring to FIGS. 1-3, the container compartment apparatus of the invention includes a storage rack 100 of given thickness from front to back. Fabricated of either wood or plastic, for example, the storage rack 100 includes a front face plate 10, a side member 12 and a back plate 14. A plurality of substantially circular apertures 16 are cut through the rack 100 from front to back—which, in a preferred embodiment of the invention, are cut through in a grid pattern of columns and rows, three of the first, and five of the second as shown in FIG. 1. Within the apertures 16, a plurality of cylindrical containers 18 are inserted, sized to fit through the apertures and closed at a first end 20. A plurality of openable closure lids 22 are sized to fit the containers 18 at a second opposite end 24, such that with the cylindrical containers being of a metal or plastic composition, the closure lids 22 are of a composition to allow a written identification on each lid as to the contents within each of the containers the lids cover.

In accordance with the invention, a major axes 17 of at least one of the containers 18 when inserted within the apertures 16 is upwardly tilted from back to front at an angle 19 between 6° and 15°. At the same time, a diameter of the container when inserted within the aperture is less than the diameter of the aperture itself to allow for a removable fit therebetween. Means are then provided to secure the storage rack 100 to vertically extending rails 23 at a wall surface shown at 25. With such wall 25 being an inside of a garage wall, for example, such means of securement can be to a pair of spaced-apart vertically extending studs of typical 16" spacing. The securement can be of any appropriate manner—such as with nails, bolts, etc. extending through a series of holes 40 shown adjacent the upper and lower edges 41 and 43 of the rack 100.

(As will be appreciated, for a craftsman and mechanic to optimally utilize the storage rack of the invention, each of the containers 18 are to be upwardly tilted from front to back at 6°-15° angles, and each are to be dimensioned to allow for ease of removal from its associated aperture. The following description, although presented in the context of this optimal utilization, will be seen to be applicable as well as where just one container is so configured.)

Different manners of obtaining the upward tilt of the containers 18 at an angle between 6° and 15° can be effected. In one construction of the invention, spacers 44 at the rear lower edge 43 of the rack 100 could be thicker than spacers 46 at the rear upper edge 41 so that when contacting the wall 25, the lower edge 43 of the rack extends further away from the wall than does the upper edge. A second way is to cut the apertures 16 through the front plate 10 to the back plate 14 at a downward slope of 6°-15°—instead of perpendicular to the plates 10, 14 —and forgo the spacers 44, 46. Alternatively, and as shown in FIG. 4, upper and lower spacer bars 50, 52 may span and be connected between the rails or studs, fixed to the rack by means of the holes 40, nails and bolts, etc.; the bars 50 and 52 would be of the same thickness where the spaces 44 and 46 are employed or where the apertures 16 are so angled,—or the upper spacer bar 50 may be of a lesser thickness than the lower spacer bar 52 where the spaces 44 and 46 are not used, and the apertures 16 are not so angled. In any one arrangement, the 6°-15° angle retains the substantially cylindrical containers 18 within their respective apertures 16, and with the tilt assuring that the container contents are retained in place. With a plastic cover lid 22, a felt-tip marker could easily be employed to identify the contents of the storage container as being one for the storage of screws, nuts, washers, bolts, springs, dowels, nails, knobs, anchors, and caps of different sizes, compositions and types. And, by having the diameter of each container less than that of its associated aperture, each of the containers can easily be removed from the rack to be taken wherever the craftsman or mechanic may need to be then working.

Testing has further shown that coffee cans lend themselves quite well to this type of container compartment apparatus—particularly 13 ounce cans of substantially 4" diameter, inserted within a circular aperture of some 4-¼" diameter. With the height of such cans being some 5-½" (as shown at 101 in FIG. 2), this allows for the storage in each container of large numbers of these various kinds of items. An orthogonally configured rack 100 lends itself quite well in this manner, and easily accepts the upwardly angled containers for use and allows for their simple removal.

While there have been described what are considered to be preferred embodiments of the present invention, it will be readily appreciated by those skilled in the art that modifications can be made without departing from the scope of the teachings herein. Thus, whereas the orthogonal configuration of the storage rack of the drawing illustrates the apertures receiving the containers to be in a grid pattern of 3 columns and 5 rows, other grid patterns and other configurations may be utilized instead. Additionally, whereas coffee cans have been found to be particularly useful as the containers, other containers of metal, plastic and glass composition may be used almost equally as well. For at least such reasons, therefore, resort should be had to the claims appended hereto for a true understanding of the scope of the invention.

I claim:

1. A container compartment apparatus for permanent securement to a vertically-studded wall surface comprising:

a pair of spaced-apart vertically extending rails;

a wood or plastic storage rack of given thickness having a front face plate, a rear plate, and a void space therebetween;

means for securing both said front plate and said rear plate of said rack to said rails and to said vertically-studded wall surface;

a plurality of substantially circular apertures cut in said rack, individual ones being colinearly cut through said front face plate, said void space, and said rear plate;

a plurality of cylindrical can containers closed at a first end and sized to fit through said apertures;

a plurality of openable snap-on plastic closure lids sized to fit said can containers at a second opposite open end thereof;

a written identification on each of said closure lids of any contents placed within each of said can containers;

means for securing said pair of vertically extending rails to adjacent studs of said wall surface in aligning a major axis of each of said can containers when inserted within said apertures at an upward tilt from said rear plate to said front face plate at an angle between 6° and 15°;

with the diameters of said plurality of can containers when inserted within said apertures being less than the diameter of its associated substantially circular aperture in providing a loose fit therebetween;

and with groupings of individual ones of screws, nuts, washers, bolts, springs, dowels, nails, knobs, anchors and caps of different sizes, compositions and types being stored as contents within each cylindrical can container corresponding to its individually written identification on each of its said snap-on closure lids.

2. The apparatus of claim 1 wherein said means for securing said storage rack to said rails secures said rack to said rail at upper and lower edges of said rack.

3. The apparatus of claim 2, also including a plurality of spacers at the rear plate of said storage rack and wherein said plurality of substantially circular apertures are cut through said storage rack at said angle of between 6° and 15° by cutting downwardly through said thickness of said rack from said front face plate to said rear plate.

4. The apparatus of claim 1 wherein said plurality of substantially circular apertures are cut through said storage rack in a grid pattern of columns and rows.

5. The apparatus of claim 1 wherein said plurality of substantially circular apertures are cut through said storage rack at said angle of between 6° and 15° by cutting angularly down from said front face plate to said rear plate through said thickness of said rack.

6. The apparatus of claim 1 wherein said plurality of cylindrical containers are sized to fit through said substantially circular apertures to reach said wall surface.

7. The apparatus of claim 1 wherein said plurality of substantially circular apertures are cut perpendicularly through said storage rack from said front face plate to said rear plate and, also including a plurality of spacers at the rear plate of said storage rack for tilting said rack upwardly at said angle of between 6° and 15°.

8. The apparatus of claim 7 for a storage rack having a bottom surface and a top surface, and wherein individual ones of said plurality of spacers closer to said bottom surface of said storage rack are of a thickness greater than individual ones of said plurality of spacers closer to said top surface of said storage rack.

9. The apparatus of claim 1 wherein said means for securing said storage rack to said rails includes upper and lower spacer bars connected between said rails, and means securing upper and lower edges of said rack to said upper and lower spacer bars, respectively.

10. The apparatus of claim 1 wherein said storage rack is of orthogonal configuration, and wherein said plurality of substantially circular apertures are cut through said storage rack in a grid pattern of columns and rows.

* * * * *